United States Patent [19]

Cooksey et al.

[11] Patent Number: 5,066,060

[45] Date of Patent: Nov. 19, 1991

[54] RUNNING TOOL

[75] Inventors: Andrew G. Cooksey, Coppell; David L. Reesing, Irving, both of Tex.

[73] Assignee: Otis Engineering Corp., Dallas, Tex.

[21] Appl. No.: 508,250

[22] Filed: Apr. 11, 1990

[51] Int. Cl.[5] ..... E21B 23/02

[52] U.S. Cl. ..... 294/86.18; 294/86.25; 166/178

[58] Field of Search ..... 294/86.1, 86.17, 86.18, 294/86.19, 86.2, 86.21, 86.24, 86.25; 166/123, 125, 178, 181, 182, 206

[56] References Cited

U.S. PATENT DOCUMENTS

| | | | |
|---|---|---|---|
| 3,863,974 | 2/1975 | Dinning | 294/86.18 X |
| 3,874,448 | 4/1975 | McGowen, Jr. et al. | 294/86.18 X |
| 4,181,344 | 1/1980 | Gazda | 294/86.18 |
| 4,811,784 | 3/1989 | Theiss | 294/86.25 X |
| 4,838,594 | 6/1989 | Bullard | 294/86.18 |
| 4,848,820 | 7/1989 | Morrell | 294/86.18 |

*Primary Examiner*—Margaret A. Focarino
*Assistant Examiner*—Dean J. Kramer
*Attorney, Agent, or Firm*—Ross, Howison, Clapp & Korn

[57] ABSTRACT

A running tool useful for installing lock mandrels and other subsurface wireline tools in a well bore, the running tool comprising top sub (12), retainer sleeve (14), bottom setting sleeve (16), core (18), insertion sleeve (44) and lockout sleeve (66). Running tool (10) is adapted to set lock mandrel (22) in landing nipple (60) and thereafter be released by jarring up to disengage lock retainer lug (28) from recess (30) in lock mandrel (22) and to disengage locking sleeve lug (32) from recess (34) in locking sleeve (36). Outwardly biased leaf spring (108) and latching lug (112) are provided to lock running tool (10A) in a fully released position. Emergency shear screws (68) and lockout lugs (90) are provided to permit withdrawal of running tool (10) and lock mandreal (22) from the well bore in case of a misrun.

15 Claims, 6 Drawing Sheets

RUNNING TOOL

TECHNICAL FIELD

This invention relates to running tools suitable for use with subsurface wireline equipment. More particularly, the invention relates to an improved running tool adapted for use in installing well tools such as lock mandrels and subsurface safety valves in a well bore.

BACKGROUND OF THE INVENTION

Running tools useful for installing lock mandrels and surface-controlled, wireline-retrievable safety valves in well bores are previously known. Difficulties have been experienced, however, when using conventional running tools that are piston sensitive to set lock mandrels and safety valves, especially in staggered bores. Such difficulties can arise where it is necessary to establish control line pressure to open the subsurface safety valve before the running tool can be released from the lock mandrel and withdrawn from the hole.

An improved running tool is needed that can install a lock mandrel and then be released without regard to the type or configuration of the tool, if any, being held by the lock mandrel. More particularly, a running tool is needed that can install an OTIS SAFETYSET lock mandrel in a staggered bore and then be released without establishing control line pressure.

SUMMARY OF THE INVENTION

According to the present invention, a running tool is provided that can be used to run a lock mandrel and subsurface safety valve into a well bore, set the lock mandrel in a landing nipple and then release the lock mandrel without first pressuring open the safety valve.

According to a preferred embodiment of the invention, a running tool is provided that comprises a top sub, retainer sleeve, bottom setting sleeve, core, insertion sleeve, lockout sleeve, lock retainer lug and locking sleeve lug. Means are provided whereby a desired alignment is maintained between the running tool and lock mandrel while being run into a well bore. The running tool is further adapted to set the lock mandrel in a landing nipple disposed in a well bore by sequential downward and upward jarring. After the lock mandrel is set, the running tool is adapted to release from the lock mandrel without any need for establishing control line pressure to a safety valve or other subsurface wireline equipment.

According to another preferred embodiment of the invention, emergency shear screws and lockout lugs are provided to permit withdrawal of the running tool and lock mandrel from the well bore in case of a misrun.

According to another embodiment of the invention, a running tool is provided for use with subsurface wireline equipment, and preferably comprises means for releasably coupling the running tool to a lock mandrel to permit the lock mandrel to be lowered into engagement with a landing nipple in a well bore; means for locking the lock mandrel in the landing nipple; and means for releasing the running tool from the lock mandrel after the lock mandrel is locked in the landing nipple.

BRIEF DESCRIPTION OF THE DRAWINGS

The apparatus of the invention is further described and explained in relation to the following figures of the drawings wherein.

Like numerals are use to indicate like parts in all figures of the drawings.

DESCRIPTION OF THE PREFERRED EMBODIMENTS

Figure 1:
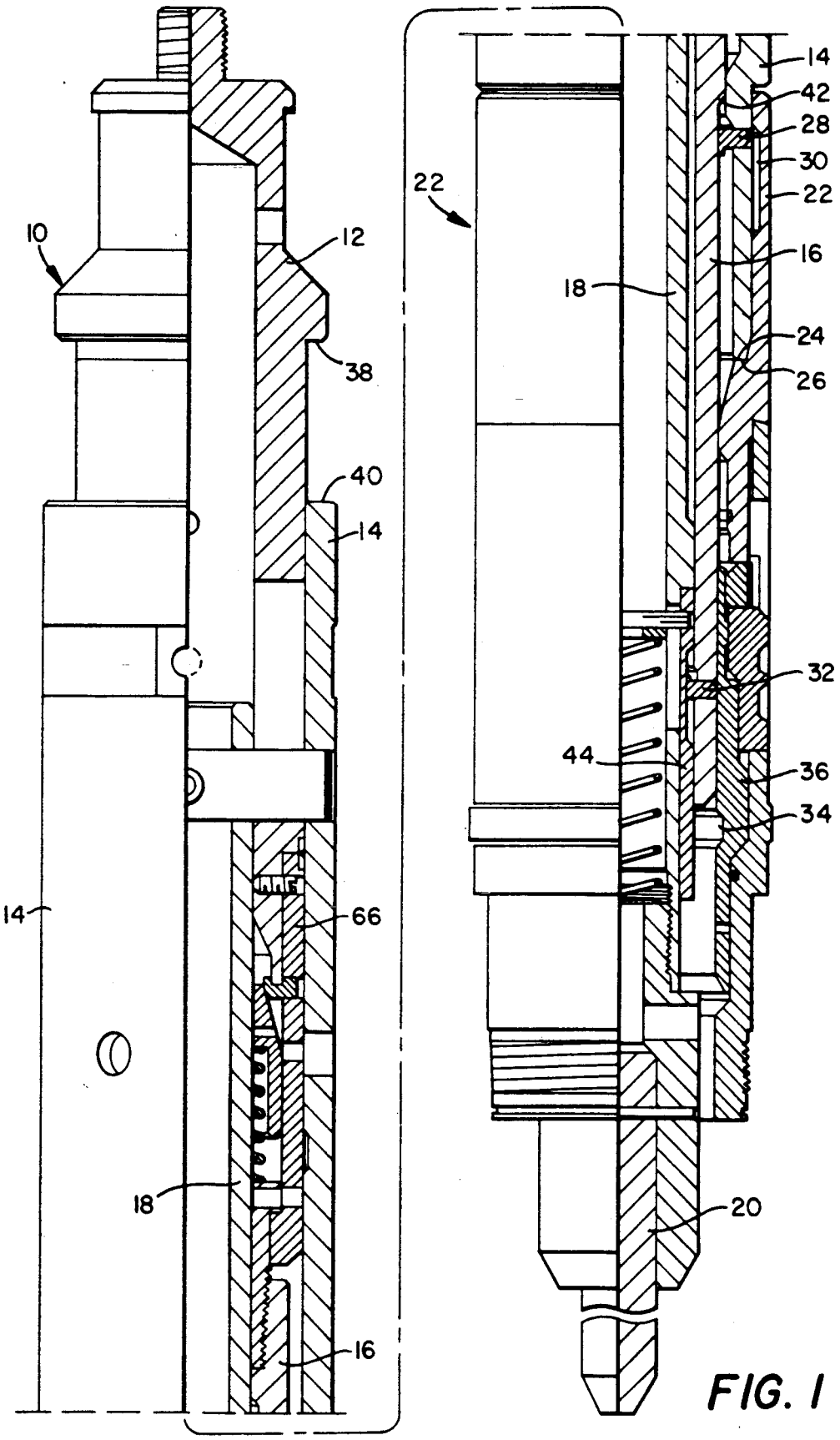
FIG. 1 is a partial cross-sectional elevational view depicting the subject running tool when first inserted into a lock mandrel.

Referring to FIG. 1, running tool 10 is shown as it is first inserted into lock mandrel 22 prior to running the combined tools into a well bore on a wireline tool string. Running tool 10 is preferably inserted sufficiently into lock mandrel 22 that lower shoulder 24 of retainer sleeve 14 abuts annular shoulder 26 of lock mandrel 22. Running tool 10 further comprises top sub 12, lower setting sleeve 16, core 18, prong 20, insertion sleeve 44, lockout sleeve 66, and other elements that are described below in relation to the use and operation of the subject invention.

As shown in FIG. 1, top sub 12 is axially extended relative to retainer sleeve 14 of running tool 10, and shoulder 38 of top sub 12 is spaced well apart from shoulder 40 of retainer sleeve 14. Lock retainer lug 28 and locking sleeve lug 32 are both in their retracted positions so that running tool 10 can be inserted into lock mandrel 22 until lower shoulder 24 contacts annular shoulder 26. Although only one lock retainer lug 28 and one locking sleeve lug 32 are shown in FIG. 1, it will be understood that a plurality of such lugs are desirably circumferentially spaced within running tool 10.

Figure 2:
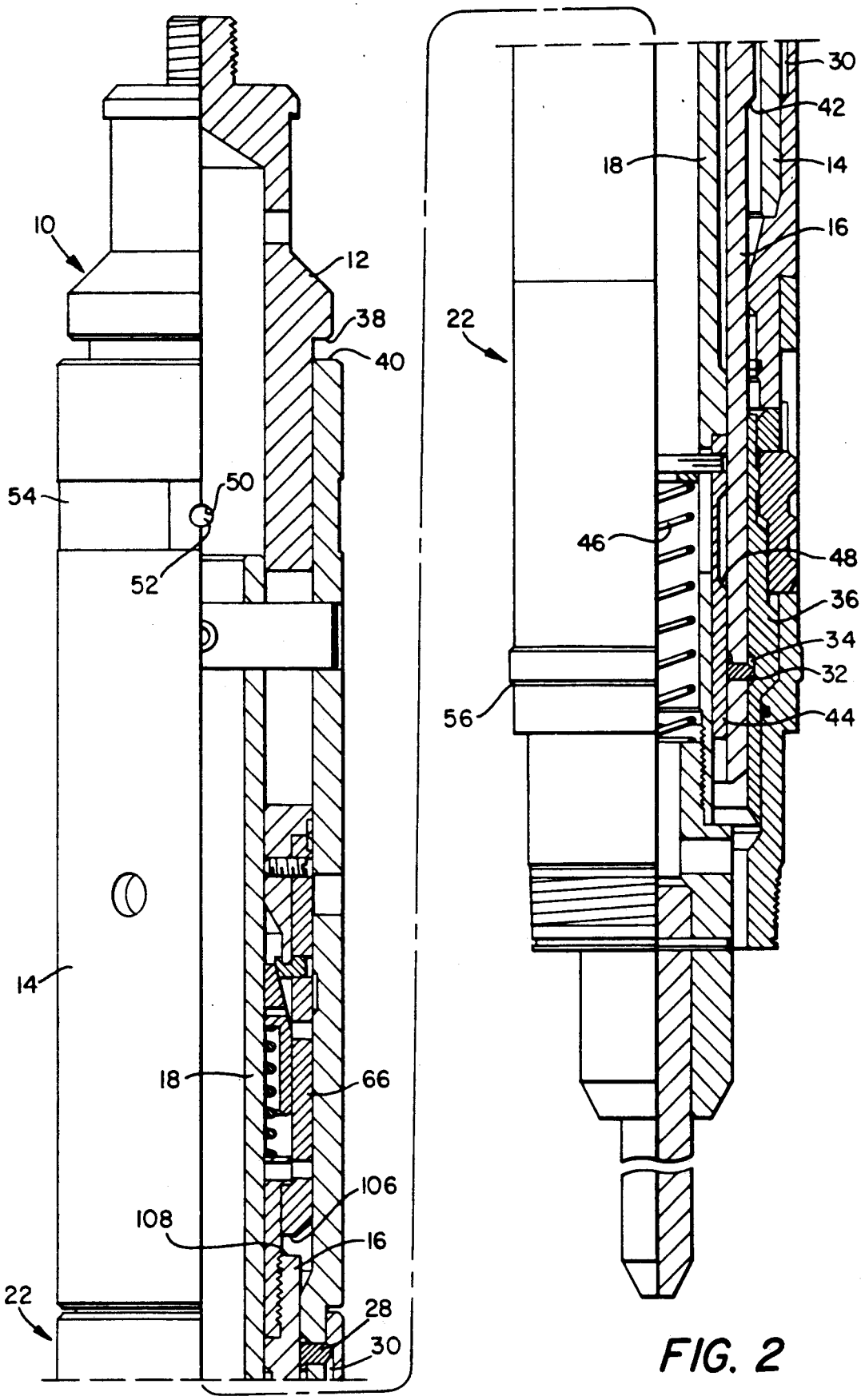
FIG. 2 is a partial cross-sectional elevational view depicting the subject running tool when installed in a lock mandrel in position to be run into a well bore.

Referring to FIG. 2, after running tool 10 is inserted into lock mandrel 22, top sub 12 is forced downward relative to retainer sleeve 14, thereby reducing the gap between shoulder 38 and shoulder 40. Simultaneously, ramp 42 of lower setting sleeve 16 is forced under lock retainer lug 28, camming it radially outward into annular recess 30 of lock mandrel 22 to hold the weight of lock mandrel 22 and any attached tool, such as a subsurface safety valve, while running into the well bore.

As lower setting sleeve 16 is forced downward relative to lock mandrel 22, locking sleeve lug 32 is carried downward until it is opposite annular recess 34 in locking sleeve 36. As locking sleeve lug 32 moves downward relative to locking sleeve 36 of lock mandrel 22, it also forces insertion sleeve 44 downward, compressing spring 46. When locking sleeve lug 32 is opposite annular recess 34, spring 46 forces insertion sleeve 44 upward, and ramp 48 on insertion sleeve 44 cams locking sleeve lug 32 into annular recess 34 to hold locking sleeve 36 in the unlocked position.

Shear pin 52 is preferably inserted into aperture 50, pinning top sub 12 to retainer sleeve 14 so that further axial motion between top sub 12 and retainer sleeve 14 is restricted while running tool 10 and lock mandrel 22 are run into the well bore. Shear pin 52 thus maintains the alignment needed within running tool 10 to prevent lock retainer lug 28 and locking sleeve lug 32 from disengaging lock mandrel 22 prematurely.

Figure 3:
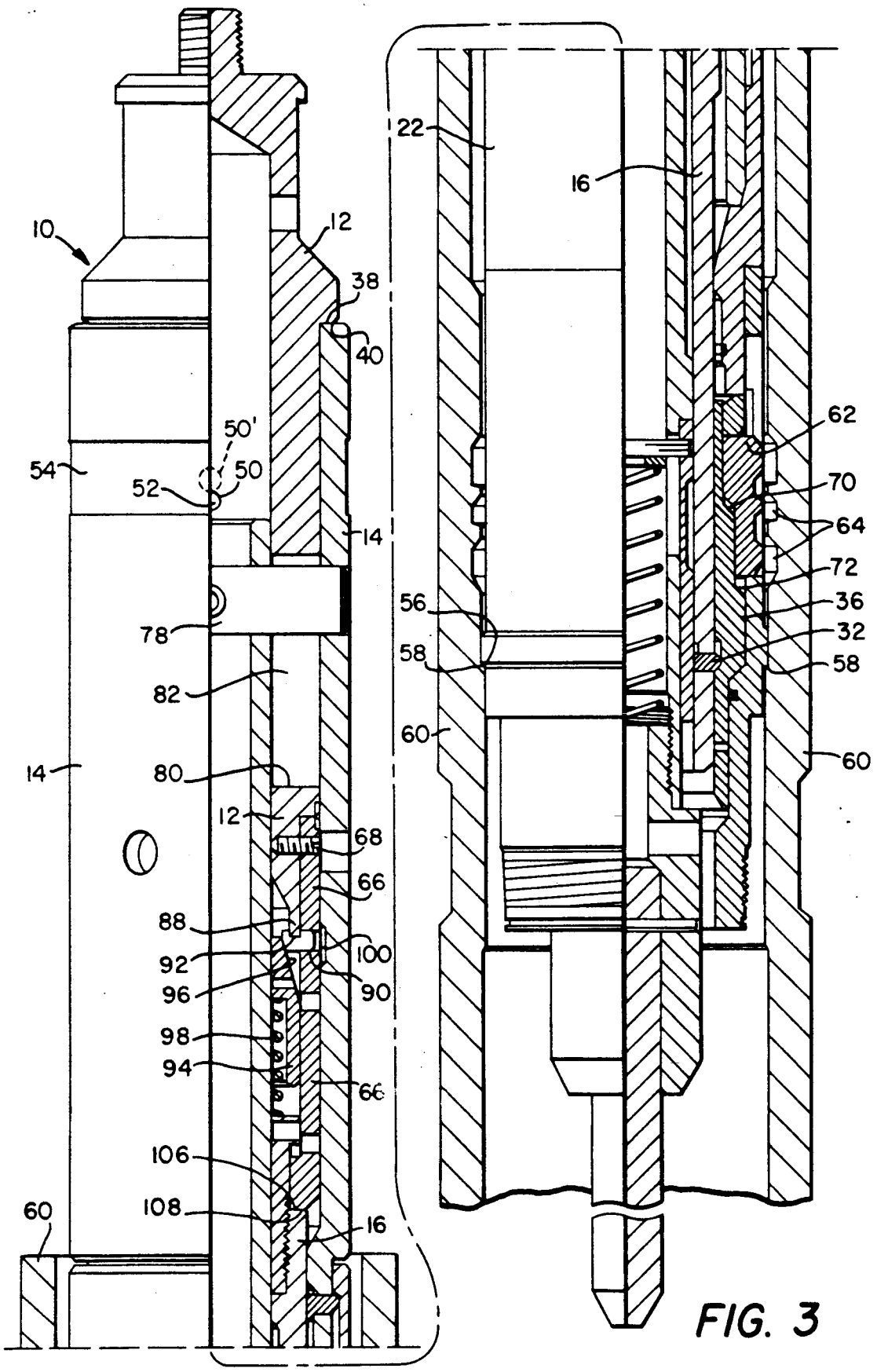
FIG. 3 is a partial cross-sectional elevational view depicting the subject running tool after being run into a landing nipple in a well bore and jarred down to shear a pin connecting the top sub to the retainer sleeve.

After shear pin 52 is inserted into aperture 50, rotating band 54 on retainer sleeve 14 is preferably rotated over aperture 50 as shown in FIG. 3 to prevent shear pin 52 from working out of aperture 50 while running into the hole.

Referring to FIG. 3, running tool 10 and lock mandrel 22 are lowered into a well bore until shoulder 56 of lock mandrel 22 contacts no-go 58 of landing nipple 60, thereby preventing further downward travel. Once shoulder 56 is seated against no-go 58, top sub 12 is jarred downward to shear pin 52. When pin 52 shears, shoulders 38, 40 are forced into abutting contact, eliminating the gap between them. That portion of aperture 50 which extends through retainer sleeve 14 beneath rotating band 54 is shown in hidden outline as aperture 50'.

Figure 4:
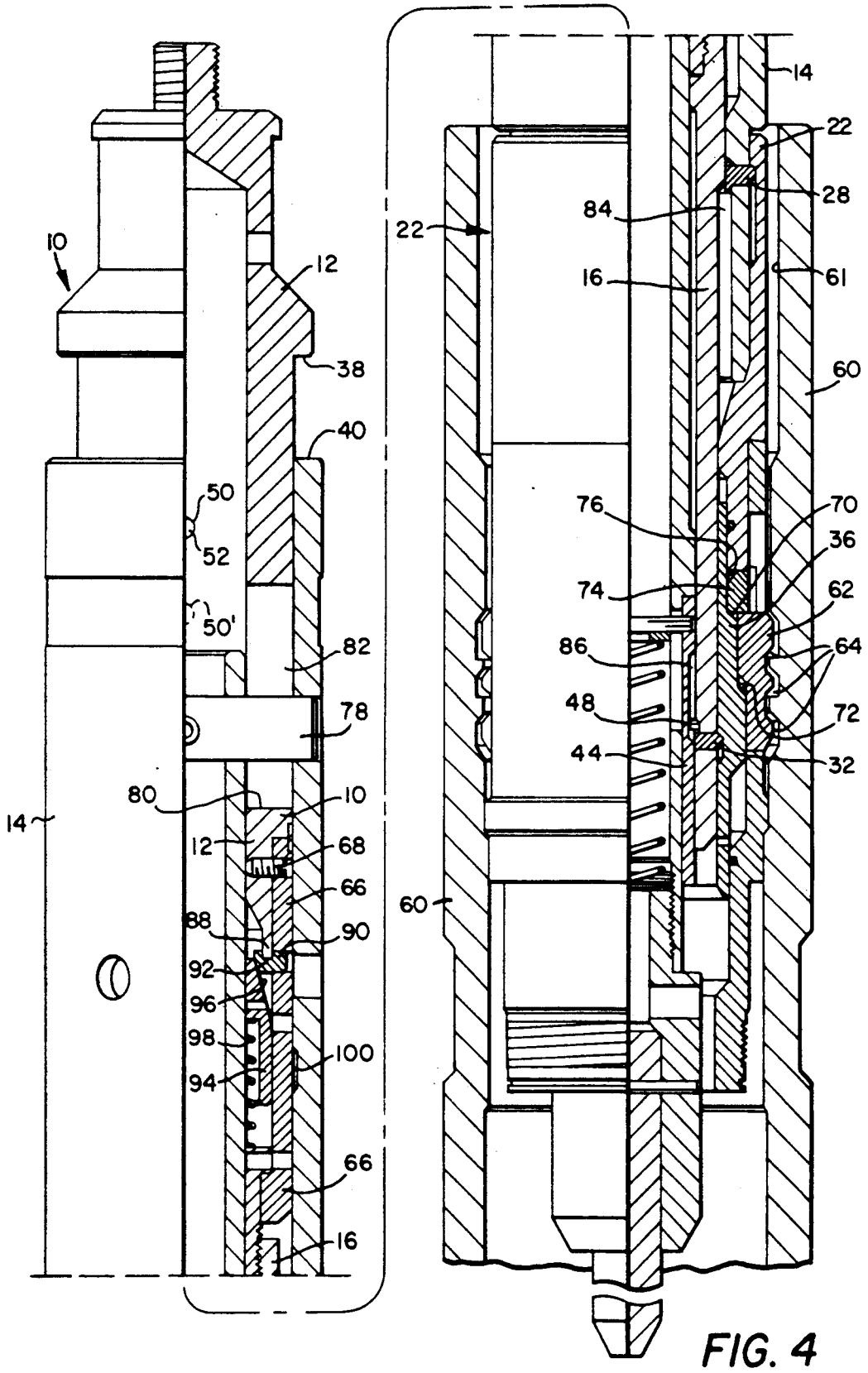
FIG. 4 is a partial cross-sectional elevational view depicting the subject running tool after being jarred up to lock the locking keys of a lock mandrel into the annular recesses of a profile in a landing nipple.

Referring to FIG. 4, after pin 52 is sheared, top sub 12 of running tool 10 is jarred upward to lock locking keys 62 in the annular recesses of profile 64 of landing nipple 60, thereby restricting further axial movement between lock mandrel 22 and landing nipple 60 until such time as the locking keys are again withdrawn. As top sub 12 is jarred upward relative to retainer sleeve 14, shoulders 38 and 40 separate again, and lower setting sleeve 16 is pulled upward by lockout sleeve 66. Lockout sleeve 66 is preferably attached to top sub 12 by a plurality of circumferentially spaced shear screws 68. According to one preferred embodiment of the invention, six circumferentially spaced shear screws 68 are provided.

As lower setting sleeve 16 is pulled upward, locking sleeve lug 32 causes locking sleeve 36 to move upward, and ramps 70, 72 of locking sleeve 36 slide beneath the inwardly facing surfaces of locking keys 62, forcing them radially outward. Locking sleeve lug 32 also slides upwardly along insertion sleeve 44 as locking keys 62 are locked into profile 64. When locking sleeve 36 rises sufficiently that locking keys 62 are fully engaged in profile 64, locking ring 74 snaps into detent 76 on locking sleeve 36 to prevent locking sleeve 36 from falling back down and unintentionally unlocking lock mandrel 22 from landing nipple 60 following removal of running tool 10.

As shown in FIG. 4, running tool 10 and lock mandrel 22 are still engaged by lock retainer lug 28 and locking sleeve lug 32, even after lock ring 74 has snapped into detent 76 on locking sleeve 36. This feature of the subject invention insures that running tool 10 will not be released from lock mandrel 22 until lock mandrel 22 is fully locked in landing nipple 60.

Figure 5:
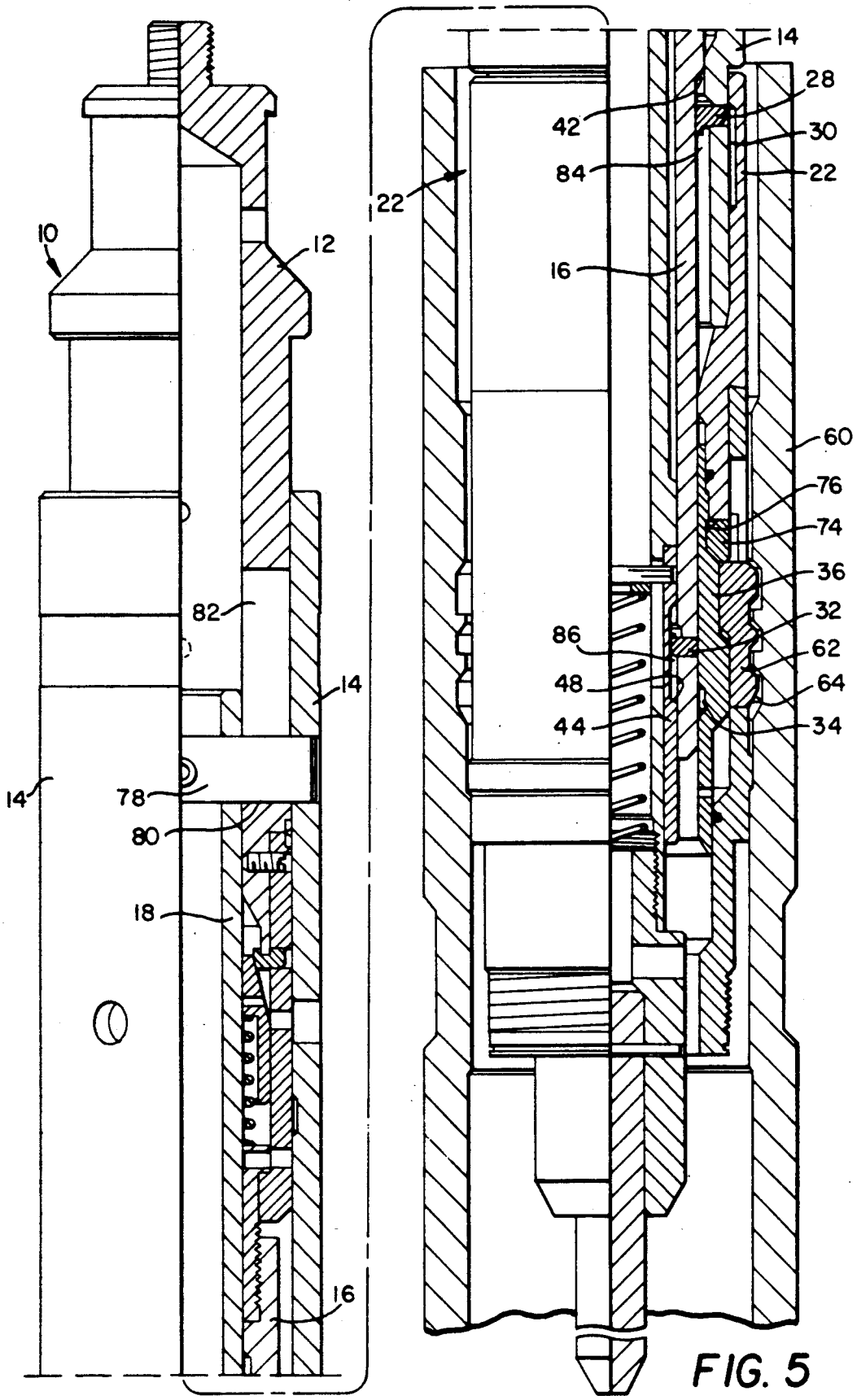
FIG. 5 is a partial cross-sectional elevational view depicting the subject running tool after it is released from the lock mandrel and ready to be withdrawn from the well bore.

During upward jarring, as shown in FIG. 5, top sub 12 is preferably drawn upward beyond the point required for lock ring 74 to snap into detent 76 of locking sleeve 36. Locking sleeve lug 32 then slides back down ramp 48 into recess 86 in insertion sleeve 44. Lock retainer lug 28 slides down ramp 42 into recess 84 and out of engagement with recess 30 of lock mandrel 22. The upward travel of top sub 12 relative to retainer sleeve 14 stops when bottom 80 of window 82 in top sub 12 contacts cross-pin 78, which extends transversely through running tool 10 and pins retainer sleeve 14 to core 18. Once lock retainer lug 28 and locking sleeve lug 32 are retracted to the positions shown in FIG. 5, running tool 10 can be withdrawn upwardly out of lock mandrel 22 to the surface.

In actual practice, the sequence of events from the position depicted in FIG. 3 to the position depicted in FIG. 5 preferably happens continuously and almost instantaneously, so that with one good upward jar lick, locking keys 62 engage profile 64, lugs 28, 32 are disengaged from lock mandrel 22, and running tool 10 is released.

Another significant feature of running tool 10 is further described in relation to FIGS. 2 and 3. Referring to FIG. 2, the gap between shoulder 38 of top sub 12 and shoulder 40 of retainer sleeve 14 is preferably the same or slightly greater than the gap between shoulder 106 of lockout sleeve 66 and shoulder 108 of lower setting sleeve 16. If constructed in this manner, whenever top sub 12 is jarred down, as shown in FIG. 3, much of the jarring force will be transmitted from top sub 12 to retainer sleeve 14 through abutting shoulders 38, 40, and not downward through lower setting sleeve to locking sleeve lug 32 and locking sleeve 36. This will reduce wear and damage to locking sleeve lug 32.

Figure 6:
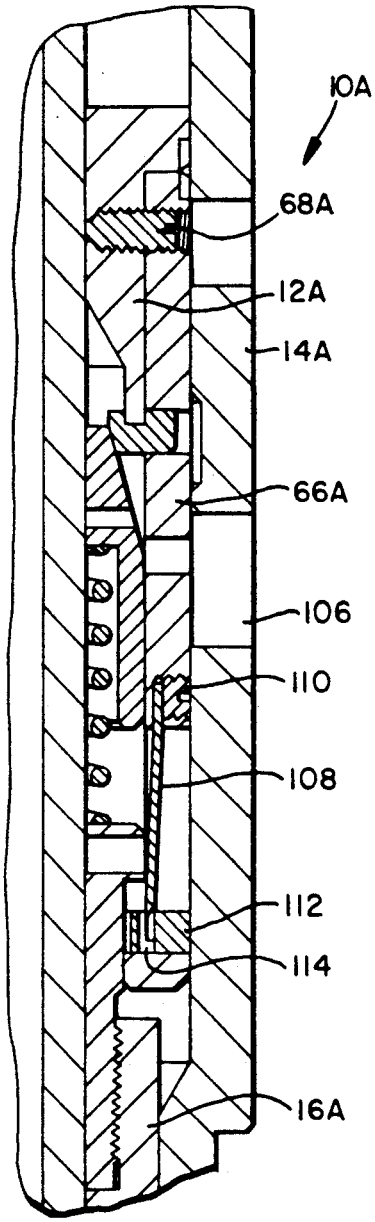
FIG. 6 is an enlarged, cross-sectional detail view of a portion of the running tool of the invention as shown in the position of FIG. 3, but also depicting a preferred means for latching the lockout sleeve to the retainer sleeve whenever the lock retainer lug is disengaged from the lock mandrel as shown in FIG. 5.
Figure 7:
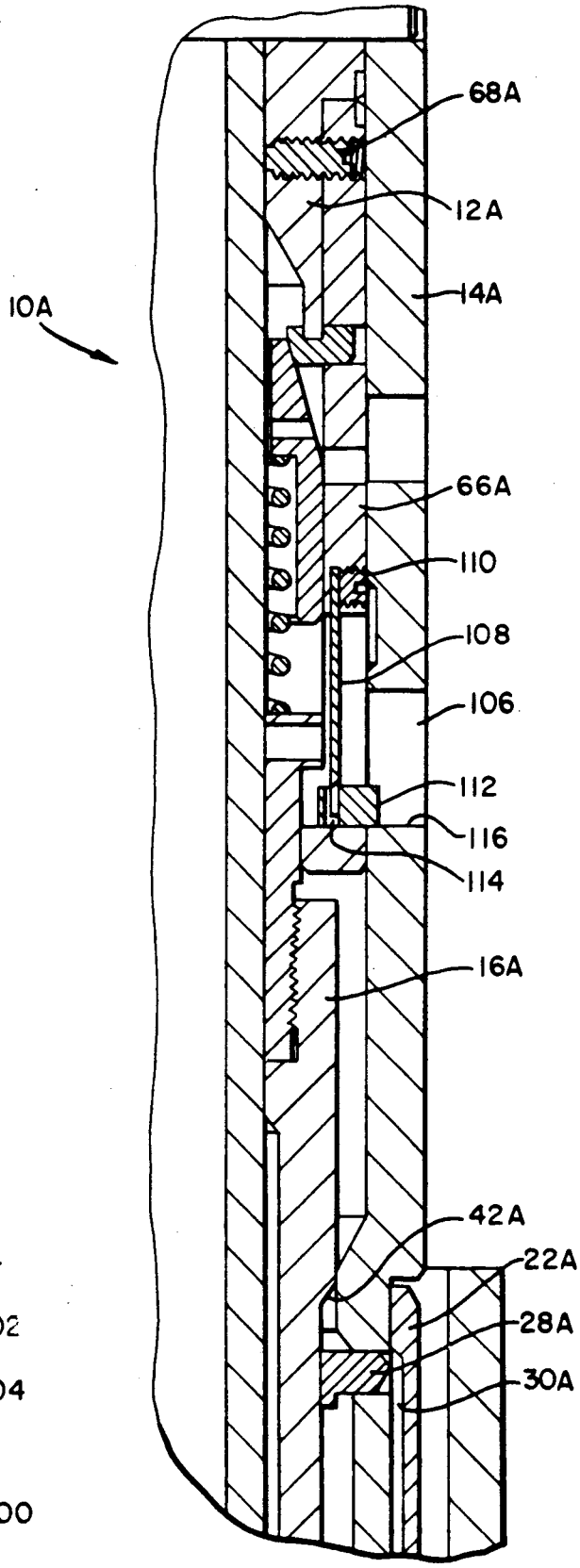
FIG. 7 is an enlarged, cross-sectional detail view of a portion of the subject running tool as shown in the position of FIG. 5, in which the means for latching the lockout sleeve to the retainer sleeve as shown in FIG. 6 has engaged a window in the retainer sleeve to prevent the top sub from shifting back down relative to the retainer sleeve, which could otherwise cause the lock retainer lug to accidentally reengage the lock mandrel.

According to a particularly preferred embodiment of the invention, as described in relation to FIGS. 6 and 7, running tool 10A is provided with means for latching lockout sleeve 66A to retainer sleeve 14A after lockout lug 28A is retracted from annular recess 30A of lock mandrel 22A. FIG. 6 is an enlarged detail view of a portion of running tool 10A in which the positions of the other elements within the running tool generally correspond to those shown in FIG. 3. FIG. 7 is a similarly enlarged detail view of a portion of running tool 10A in which the positions of the other elements within the running tool generally correspond to those shown in FIG. 5.

Referring to FIGS. 6 and 7, lockout sleeve 66A of running tool 10A preferably further comprises leaf spring 108, set screw 110, and latching lug 112. Leaf spring 108 preferably extends into slot 114 of latching lug 112, and is biased radially outward, causing latching lug 112 to press against retainer sleeve 14A. Retainer sleeve 14A is provided with window 106. As top sub 12A of running tool 10A is jarred upward relative to retainer sleeve 14A, leaf spring 108 forces latching lug radially outward into window 106, and locks running tool 10A in the fully released position. Shoulder 116 of window 106 thereafter prevents lug 112, leaf spring 108, lockout sleeve 66A, top sub 12A and lower setting sleeve 16A from sliding back down a sufficient distance that ramp 42A can cause lock retainer lug 28A to accidentally extend back out into recess 30A and reengage lock mandrel 22A. Although only one leaf spring 108, latching lug 112 and window 106 are shown in FIGS. 6 and 7, it will be apparent that a plurality of such latch assemblies can be circumferentially spaced around running tool 10A for greater effectiveness if desired.

Figure 8:
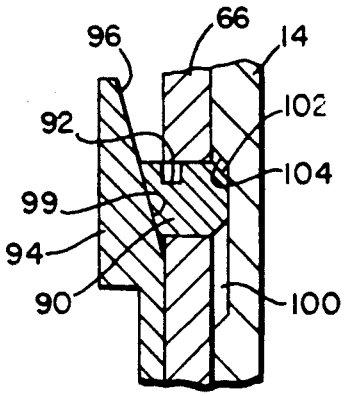
FIG. 8 is an enlarged, cross-sectional detail view depicting the manner in which the lockout lug locks the lower setting sleeve to the retainer sleeve when the shear screws of the subject running tool have been sheared to permit withdrawal of the running tool and lock mandrel from the well bore in case of a misrun.

Yet another novel and useful feature of running tool 10 disclosed herein is described in further detail in relation to FIGS. 3, 4 and 8. Difficulties are sometimes encountered in lowering running tool 10 and lock mandrel 22 to the point where shoulder 56 as shown in FIG. 3 can reach and seat against no-go 58 of landing nipple 60. In such instances, shear pin 52 will likely be sheared as running tool 10 and lock mandrel 22 are jarred downward in an effort to reach no-go 58. Once pin 52 is sheared, further upward movement or jarring of running tool 10 will cause top sub 12 and lower setting sleeve 16 to slide upwardly relative to retainer sleeve 14 and lock mandrel 22. When this occurs, if locking keys 62 are not aligned with profile 64 as shown in FIG. 4, locking keys 62 will bind against inside wall 61, locking sleeve 36 will not be pulled upward by locking sleeve lug 32 a sufficient distance to permit locking sleeve lug 32 to be cammed into recess 86 in insertion sleeve 44, and lower setting sleeve 16 cannot rise relative to retainer sleeve 14 a sufficient distance that lock retainer lug 28 can drop out of engagement with lock mandrel 22 into recess 84. Thus, lock mandrel 22 will not be properly set in landing nipple 60, and running tool 10 will not be released. If the operator attempts to withdraw running tool 10 from the well bore with pin 52 sheared but with lock mandrel 22 still attached, locking keys 62 are likely to engage and hang up on any other recess, shoulder or partial obstruction encountered as they are raised toward the surface.

With the present invention, the difficulties referred to in the foregoing paragraph can be obviated by jarring upward on top sub 12 sufficiently hard to shear screws 68. Referring to FIG. 3, which shows the relative positions of the parts just before screws 68 are sheared (again assuming that locking keys 62 are not properly aligned with profile 64 of landing nipple 60), this upward jarring will simultaneously withdraw downwardly extending lip 88 from groove 92 in lockout lug 90. Once lip 88 releases from groove 92, lockout lug carrier sleeve 94 will be forced upwardly by spring 98, and ramp 96 will force lockout lug 90 radially outward into annular recess 100 of retainer sleeve 14 as shown in more detail in FIG. 8. After shearing shear screws 68, a light downward jar may be required to insure that lockout lug 90 has fully engaged annular recess 100. Lockout sleeve 66 and lower setting sleeve 16 will then be linked to retainer sleeve 14, which is already linked by cross-pin 78 to core 18. Top sub 12 will slide upwardly until bottom 80 of window 82 contacts cross-pin 78, after which the entire running tool and lock mandrel assembly can be withdrawn from the well bore. Once lockout sleeve 66 and lower setting sleeve 16 are pinned to retainer sleeve 14 by lockout lug 90, locking sleeve 36 will remain in its downward position relative to locking keys 62, and locking keys 62 will remain retracted as running tool 10 and lock mandrel 22 are withdrawn.

According to a particularly preferred embodiment of the invention, as shown in FIG. 8, ramp 96 and facing surface 99 on the bottom of lockout lug 90 are both inclined about 15 degrees from vertical. Bearing surface 102 of lockout lug 90 and bearing surface 104 of retainer sleeve 14, on the other hand, are both inclined about 45 degrees from vertical. This differential angle of inclination mechanically locks lockout lug 90 in place within recess 100 because you cannot exert enough force on bearing surface 102 to cause ramp 96 to slide back downward relative to facing surface 99. Although only one lockout lug 90 is depicted in the drawings, it will be understood that a plurality of circumferentially spaced lockout lugs 90 can likewise be used within the scope of the invention. According to one preferred embodiment of the invention, three circumferentially spaced lockout lugs 90 are provided for use in running tool 10.

It is understood that other alterations and modifications of the invention will become apparent to those of ordinary skill in the art after reviewing the present disclosure, and it is therefore intended that the scope of the invention be limited only by the broadest interpretation of the appended claims to which the inventors are legally entitled.

We claim:

1. A running tool for use with subsurface wireline equipment, the running tool comprising:

means for releasably coupling the running tool to a lock mandrel to permit the lock mandrel to be lowered into engagement with a landing nipple in a well bore;

means for locking the lock mandrel in the landing nipple;

means for retrieving the lock mandrel while still coupled to the running tool in case of a misrun; and means for releasing the running tool from the lock mandrel after the lock mandrel is locked in the landing nipple;

the running tool comprising first and second concentrically disposed, longitudinally slidable sleeve members;

the means for releasably coupling the running tool to the lock mandrel comprising at least one radially slidable lug member adapted to engage a recess in the lock mandrel when the first sleeve member is moved in a downward direction radially inward from the second sleeve member, the lug member being adapted to withdraw from the recess in the lock mandrel whenever the first sleeve member is moved in an upward direction radially inward from the second sleeve member; and the first sleeve member being adapted to move in the upward direction radially inward of the second sleeve member whenever the running tool is jarred upwardly.

2. A running tool for use with subsurface wireline equipment, the running tool comprising:

means for releasably coupling the running tool to a lock mandrel to permit the lock mandrel to be lowered into engagement with a landing nipple in a well bore;

means for locking the lock mandrel in the landing nipple;

means for retrieving the lock mandrel while still coupled to the running tool in case of a misrun; and means for releasing the running tool from the lock mandrel after the lock mandrel is locked in the landing nipple;

the running tool comprising first and second concentrically disposed, longitudinally slidable sleeve members;

the means for releasably coupling the running tool to the lock mandrel comprising at least one radially slidable lug member adapted to engage a recess in the lock mandrel when the first sleeve member is moved in a downward direction radially inward from the second sleeve member, and means for disengaging the lug member from the recess in the lock mandrel when the running tool is jarred upwardly after the lock mandrel is locked in the landing nipple.

3. A running tool for use with subsurface wireline equipment, the running tool comprising:

means for releasably coupling the running tool to a lock mandrel to permit the lock mandrel to be lowered into engagement with a landing nipple in a well bore;

means for locking the lock mandrel in the landing nipple;

means for retrieving the lock mandrel while still coupled to the running tool in case of a misrun; and means for releasing the running tool from the lock mandrel after the lock mandrel is locked in the landing nipple;

the running tool comprising first and second concentrically disposed, longitudinally slidable sleeve members;

the means for releasably coupling the running tool to the lock mandrel comprising at least one radially slidable lug member adapted to engage a recess in the lock mandrel when the first sleeve member is moved in a downward direction radially inward from the second sleeve member, the lug member being adapted to withdraw from the recess in the lock mandrel whenever the first sleeve member is moved in an upward direction radially inward from the second sleeve member;

the lock mandrel comprising a longitudinally slidable locking sleeve; and the means for locking the lock mandrel in the landing nipple comprising a first longitudinally slidable sleeve member and at least one radially slidable lug member adapted to engage a recess in the locking sleeve when the first sleeve member is moved downwardly relative to the locking sleeve, and a second longitudinally slidable sleeve concentrically disposed radially inward from the first sleeve, the second sleeve comprising a recess adapted to receive the lug member when the lug member is not engaged in the recess in the locking sleeve, and spring means adapted to bias the recess in the second sleeve away from the recess in the locking sleeve.

4. A running tool for use with subsurface wireline equipment, the running tool comprising:

means for releasably coupling the running tool to a lock mandrel to permit the lock mandrel to be lowered into engagement with a landing nipple in a well bore;

means for locking the lock mandrel in the landing nipple;

means for retrieving the lock mandrel while still coupled to the running tool in case of a misrun; and means for releasing the running tool from the lock mandrel after the lock mandrel is locked in the landing nipple;

the running tool comprising first and second concentrically disposed, longitudinally slidable sleeve members;

the means for releasably coupling the running tool to the lock mandrel comprising at least one radially slidable lug member adapted to engage a recess in the lock mandrel when the first sleeve member is moved in a downward direction radially inward rom the second sleeve member, the lug member being adapted to withdraw from the recess in the lock mandrel whenever the first sleeve member is moved in an upward direction radially inward from the second sleeve member;

the lock mandrel comprising a longitudinally slidable locking sleeve, and the means for locking the lock mandrel in the landing nipple comprising a first longitudinally slidable sleeve member and at least one radially slidable lug member adapted to engage a recess in the locking sleeve when the first sleeve member is moved downwardly relative to the locking sleeve, and a second longitudinally slidable sleeve concentrically disposed radially inward from the first sleeve, the second sleeve comprising a recess adapted to receive the lug member when the lug member is not engaged in the recess in the locking sleeve; and means for withdrawing the lug member from the recess in the locking sleeve and moving the lug member back into the recess in the second sleeve whenever the running tool is jarred upwardly after the lock mandrel is locked in the landing nipple.

5. A running tool for use with subsurface wireline equipment, the running tool comprising:

means for releasably coupling the running tool to a lock mandrel to permit the lock mandrel to be lowered into engagement with a landing nipple in a well bore;

means for locking the lock mandrel in the landing nipple;

means for retrieving the lock mandrel while still coupled to the running tool in case of a misrun;

means for releasing the running tool from the lock mandrel after the lock mandrel is locked in the landing nipple; and emergency means adapted to permit withdrawal of the running tool and the lock mandrel from the well bore without locking the lock mandrel in the landing nipple and without releasing the running tool from the locked mandrel, the emergency means comprising at least one shearable member adapted to be sheared by jarring the running tool upwardly.

6. The running tool of claim 5 wherein the emergency means comprises a plurality of circumferentially spaced shearable members.

7. The running tool of claim 5 wherein the emergency means comprises at least one radially slidable lug member adapted to limit relative longitudinal motion within the running tool during withdrawal of the running tool from the well bore.

8. The running tool of claim 7 wherein the emergency means further comprises a spring-biased lug carrier adapted to force the lug member radially outward when the shearable member is sheared.

9. A running tool for use with subsurface wireline equipment, the running tool comprising:

means for releasably coupling the running tool to a lock mandrel to permit the lock mandrel to be lowered into engagement with a landing nipple in a well bore;

means for locking the lock mandrel in the landing nipple;

means for retrieving the lock mandrel while still coupled to the running tool in case of a misrun;

means for releasing the running tool from the lock mandrel after the lock mandrel is locked in the landing nipple; and further comprising means for latching the released running tool after the lock mandrel is locked in the landing nipple, the means for latching the running tool comprising at least one latch assembly further comprising a leaf spring outwardly biased in the radial direction and at least one radially slidable latching lug.

10. A running tool comprising:

a retainer sleeve and a core coaxially disposed within the retainer sleeve and coupled thereto to limit relative longitudinal movement therebetween;

an insertion sleeve slidably coupled to the exterior of the core;

a top sub slidably disposed between and operably coupled to the retainer sleeve and the core;

a lockout sleeve releasably coupled to the top sub between the retainer sleeve and the core so as to limit relative longitudinal movement between the lockout sleeve and top sub while coupled;

a lower setting sleeve slidably disposed around the core and slidably coupled to the lockout sleeve;

at least one lug adapted to engage a recess in a lock mandrel to limit relative longitudinal motion between the retainer sleeve and the lock mandrel;

at least one lug adapted to engage a recess in a lock mandrel locking sleeve for use in locking the lock mandrel to a landing nipple whenever the running tool is jarred in an upward direction; and means for releasing the running tool from the lock mandrel, said means comprising means for releasing all lugs engaging the lock mandrel and lock mandrel locking sleeve when the running tool is jarred in an upward direction after the lock mandrel is locked to the landing nipple.

11. The running tool of claim 10, further comprising emergency means adapted to permit withdrawal of the running tool and the lock mandrel from a well bore without locking the lock mandrel in the landing nipple and without releasing the running tool from the lock mandrel.

12. The running tool of claim 11 wherein the emergency means comprises at least one shearable member adapted to be sheared by jarring running tool upwardly.

13. The running tool of claim 12 wherein the emergency means comprises a plurality of circumferentially spaced shearable members.

14. The running tool of claim 11 wherein the emergency means comprises at least one radially slidable lug member adapted to limit relative longitudinal motion within the running tool during withdrawal of the running tool from the well bore.

15. The running tool of claim 14 wherein the emergency means further comprises a spring-biased lug carrier adapted to force the lug member radially outward when the shearable member is sheared.

* * * * *